US007942134B2

(12) United States Patent
Peters et al.

(10) Patent No.: US 7,942,134 B2
(45) Date of Patent: May 17, 2011

(54) EVAPORATIVE EMISSION SYSTEM AND METHOD FOR CONTROLLING SAME

(75) Inventors: Mark Peters, Wolverine Lake, MI (US); Darrell Erick Butler, Macomb, MI (US); Kenneth James Miller, Canton, MI (US); Eric J. Bensen, Farmington Hills, MI (US); Kenneth L. Pifher, Holly, MI (US)

(73) Assignee: Ford Global Technologies LLC, Dearborn, MI (US)

( * ) Notice: Subject to any disclaimer, the term of this patent is extended or adjusted under 35 U.S.C. 154(b) by 126 days.

(21) Appl. No.: 12/403,070

(22) Filed: Mar. 12, 2009

(65) Prior Publication Data

US 2010/0229837 A1 Sep. 16, 2010

(51) Int. Cl.
*F02M 33/02* (2006.01)
*F02M 33/04* (2006.01)

(52) U.S. Cl. ..... 123/520

(58) Field of Classification Search ..... 123/520, 123/519, 518, 516, 704, 703, 698; 701/109, 701/103

See application file for complete search history.

(56) References Cited

U.S. PATENT DOCUMENTS

| | | | | |
|---|---|---|---|---|
| 4,700,750 | A | 10/1987 | Cook | |
| 4,748,959 | A * | 6/1988 | Cook et al. | 123/406.45 |
| 5,596,972 | A | 1/1997 | Sultan et al. | |
| 6,293,261 | B1 | 9/2001 | Oemcke et al. | |
| 6,321,735 | B2 | 11/2001 | Grieve et al. | |
| 6,523,531 | B1 | 2/2003 | Feldkamp et al. | |
| 7,305,975 | B2 | 12/2007 | Reddy | |
| 2003/0051715 | A1 * | 3/2003 | Bagnasco | 123/698 |

OTHER PUBLICATIONS

M. James Grieve, et al., Advanced Canister Purge Algorithm with a Virtual [HC] Sensor, Reprinted From: Electronic Engine Controls 2000: Controls (SP-1500), SAE Technical Paper Series, 2000-01-0557, SAE 2000 Wold Congress, Detroit, Michigan Mar. 6-9, 2000.

* cited by examiner

*Primary Examiner* — Mahmoud Gimie
(74) *Attorney, Agent, or Firm* — David B. Kelley; Brooks B. Kushman P.C.

(57) ABSTRACT

A method for controlling an automotive canister purge valve in fluid communication with an evaporative canister includes selecting a purge flow rate of increase for the purge valve based on a hydrocarbon concentration in a fluid stream exiting the evaporative canister, and operating the purge valve based on the selected rate.

13 Claims, 3 Drawing Sheets

EVAPORATIVE EMISSION SYSTEM AND METHOD FOR CONTROLLING SAME

BACKGROUND

Carbon Canisters are commonly used in the automotive industry to control the emission of hydrocarbons. For automobiles, hydrocarbon emissions may be produced during the filling of the fuel tank and during vehicle operation. When the engine is off, evaporation from the vehicle fuel system may occur.

Allowable hydrocarbon emission limits are set by government regulations. For example, the Low Emitting Vehicle-II (LEV-II) standard allows a certain amount of hydrocarbon emissions for a specific range of gross vehicle weight.

Carbon canisters may be part of an evaporative emission control system, which may include the fuel tank, vent and purge valves, and fuel lines. The carbon canister stores the fuel vapor generated in the system instead of having it escape into the atmosphere. The hydrocarbons are then burned off by purging the canister into the intake manifold when the engine is running.

SUMMARY

A method for controlling an automotive canister purge valve in fluid communication with an evaporative canister may include, for at least one of a plurality of time intervals, selecting a purge flow rate of increase for the purge valve based on a hydrocarbon concentration in a fluid stream exiting the evaporative canister, and operating the purge valve based on the selected rate.

The method may also include determining the hydrocarbon concentration in the fluid stream exiting the evaporative canister based on a change in air/fuel ratio to an engine.

The method may also include determining the change in air/fuel ratio to the engine based on a change in oxygen concentration in the exhaust stream from the engine.

A method for controlling an automotive canister purge valve in fluid communication with an evaporative canister may include, for at least one of a plurality of time intervals, determining an oxygen concentration in an exhaust stream from an engine, selecting a purge flow ramp rate for the purge valve based on the oxygen concentration, and operating the purge valve based on the selected ramp rate.

An evaporative emission control system for a vehicle including an engine may include an evaporative canister, a purge valve in fluid communication with the evaporative canister and engine, and a controller. The controller may be configured to select a purge flow rate of increase for the purge valve based on a hydrocarbon concentration in a fluid stream exiting the evaporative canister and operate the purge valve based on the selected rate.

While example embodiments in accordance with the invention are illustrated and disclosed, such disclosure should not be construed to limit the invention. It is anticipated that various modifications and alternative designs may be made without departing from the scope of the invention.

DETAILED DESCRIPTION

Figure 1:
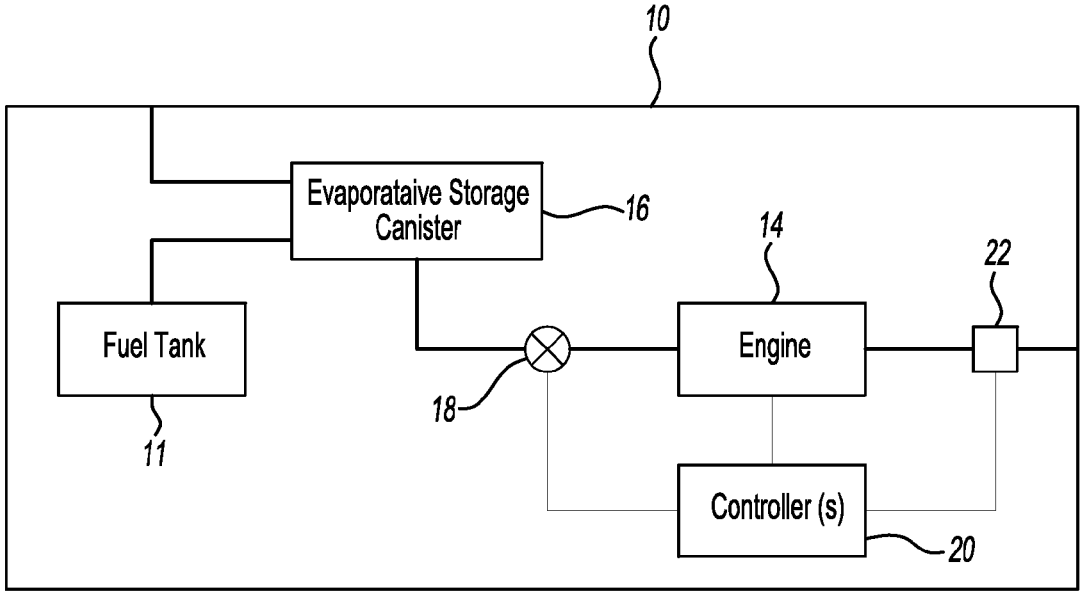
FIG. 1 is a block diagram of an embodiment of an automotive vehicle.

Referring now to FIG. 1, an embodiment of an automotive vehicle 10 (hybrid electric vehicle, conventional gasoline power vehicle, etc.) includes a fuel tank 11, engine 14 and evaporative storage canister 16. The vehicle 10 also includes a canister purge valve 18, controller(s) 20 and oxygen sensor 22. The storage canister 16 may fluidly communicate with the atmosphere, fuel tank 12 and engine 14.

As known to those of ordinary skill, fuel vapors in the fuel tank 12 are captured by the storage canister 16. These captured vapors (hydrocarbons) may be periodically purged from the storage canister 16 by operation of the purge valve 18. When the purge valve 18 is opened under the command of the controller 20, ambient air is pulled through the storage canister 16 (thus releasing hydrocarbons captured by the storage canister 16) and directed to the engine 14. The engine 14 burns these hydrocarbons and the byproducts of combustion are then exhausted to the atmosphere.

The oxygen sensor 22 senses the concentration of oxygen in the engine exhaust stream and communicates this information to the controller 20. As known to those of ordinary skill, this information may be used by the controller 20 to determine the air/fuel ratio of the engine 14.

Figure 2:
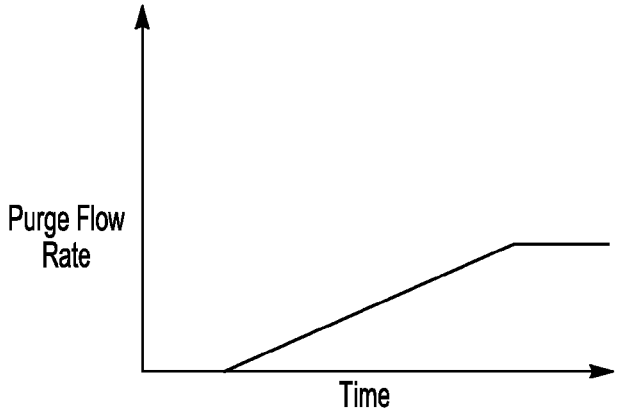
FIG. 2 is a plot of purge flow rate versus time.

Referring now to FIG. 2, a purge flow rate for a storage canister purge valve may be ramped up at a fixed rate. The ramp rate of FIG. 2 protects for a high (e.g., greater than 80%) concentration of hydrocarbons in an air stream exiting the storage canister. As a result, hydrocarbons delivered to an engine by operation of the purge valve at the fixed purge flow ramp rate should not adversely affect the emissions performance of the engine. That is, independent of the actual concentration of hydrocarbons in the air stream exiting the storage canister, the purge flow ramp rate is mild enough such that even if the concentration is high, the engine will not burn unacceptably rich.

Figure 3:
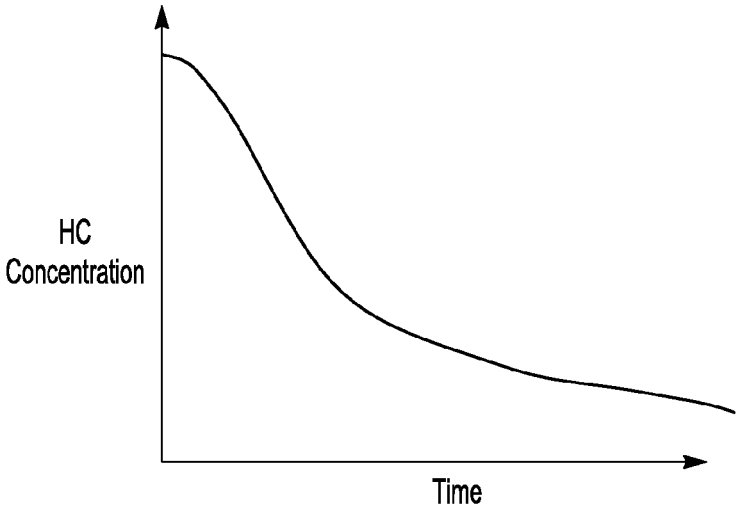
FIG. 3 is an example plot of concentration of hydrocarbons in the air stream exiting the evaporative storage canister of FIG. 1 versus time.

Referring now to FIGS. 1 and 3, the percentage concentration of hydrocarbons in the air stream exiting the storage canister 16 may vary depending on the amount of hydrocarbons stored by the storage canister 16 (and the duration of any purging). As explained below, the controller 20 may control the rate at which the purge flow is ramped up based on the concentration of hydrocarbons in the air stream exiting the storage canister 16. In certain embodiments, the lower the hydrocarbon concentration, the greater the purge flow ramp rate.

As apparent to those of ordinary skill, the mass of hydrocarbons delivered to the engine 14 increases as the hydrocarbon concentration in the air stream exiting the storage canister 16 increases for a fixed purge flow ramp rate. Of course, the engine 14 may receive and consume a threshold mass of hydrocarbons (during a time interval) from the storage canister 16 before its emissions performance is adversely affected. (If there are too many hydrocarbons, the engine 14 may burn unacceptably rich.) A ramp rate may be selected such that, for a given time interval, a mass of hydrocarbons received by the engine 14 is approximately equal to (or less than) the threshold mass.

Figure 4:
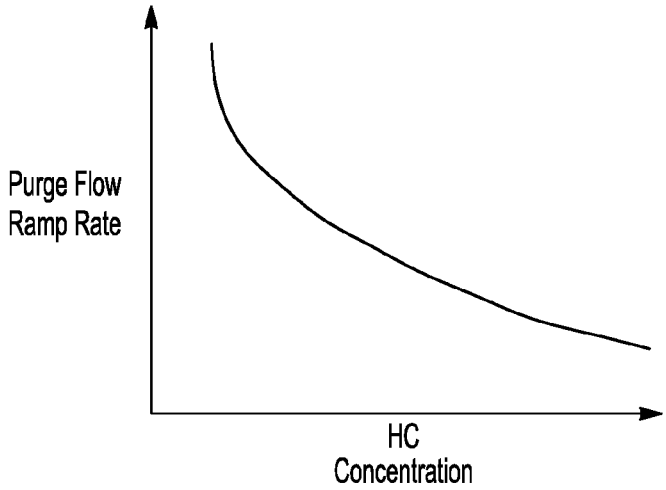
FIG. 4 is an example plot of purge flow ramp rate for the purge valve of FIG. 1 versus concentration of hydrocarbons in the air stream exiting the evaporative storage canister of FIG. 1.

Referring now to FIGS. 1 and 4, the purge flow ramp rate may increase as the hydrocarbon concentration in the air stream exiting the storage canister 16 decreases (so long as the mass of hydrocarbons delivered to the engine 14 by operation of the purge valve 18 at the ramp rate does not overwhelm the engine 14). The profile of this curve may be generated using any suitable technique, e.g., testing, simulation, etc. For example, the emissions performance of an engine may be evaluated for a number of ramp rate/hydrocarbon concentration combinations to determine those threshold ramp rates (for each hydrocarbon concentration) that do not adversely affect engine emissions performance.

Figure 5:
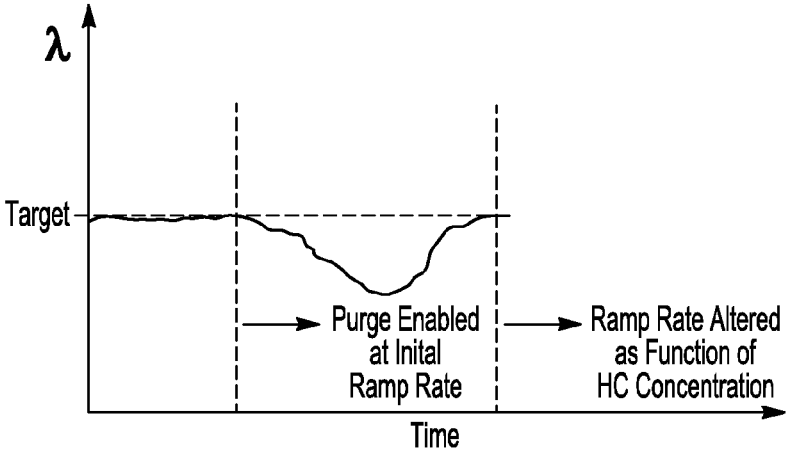
FIG. 5 is an example plot of normalized air/fuel ratio for the engine of FIG. 1 versus time.

Referring now to FIGS. 1 and 5, the controller 20 may be configured to bring the normalized air/fuel ratio (λ) for the engine 14 to a target, e.g., stoichiometric conditions, soon after the engine 14 is started as known to those of ordinary skill. This target may depend on driver demand, fuel type, exhaust after treatment type, etc. Depending on the configuration, this process may take, for example, 15 seconds.

Once the air/fuel ratio is at the target, the purge valve 18 may be enabled. As hydrocarbons are delivered to the engine 14 from the storage canister 16, the air/fuel ratio may become richer (before fuel injectors associated with the engine 14 are controlled to reduce the amount of fuel supplied to the engine 14). As known to those of ordinary skill, the concentration of hydrocarbons in the air stream exiting the storage canister 16 may be determined based on the degree to which the air/fuel ratio becomes richer/leaner relative to the target. In other embodiments, any suitable technique may be used to determine the hydrocarbon concentration in the air stream exiting the storage canister 16. For example, a hydrocarbon sensor may be used to detect the hydrocarbon concentration and communicate this information to the controller 20.

In some embodiments, the initial ramp rate of the purge valve 18 may protect for a high hydrocarbon concentration as the hydrocarbon concentration may not be immediately known. In other embodiments, particularly those that include hydrocarbon sensors, the initial ramp rate of the purge valve 18 may be selected using, for example, a plot (or table) similar to that depicted in FIG. 4 and stored in memory of the controller 20

As mentioned above, fuel injectors associated with the engine 14 may be controlled to reduce the amount of fuel supplied to the engine 14 to account for the increase in fuel supplied by operation of the purge valve 18. In some embodiments, once the air/fuel ratio again achieves the target, the purge flow ramp rate may be changed from its initial rate based on the hydrocarbon concentration. In other embodiments, the hydrocarbon concentration may be determined periodically, e.g., every 100 milliseconds, using known techniques and the purge flow ramp rate adjusted accordingly.

Figure 6:
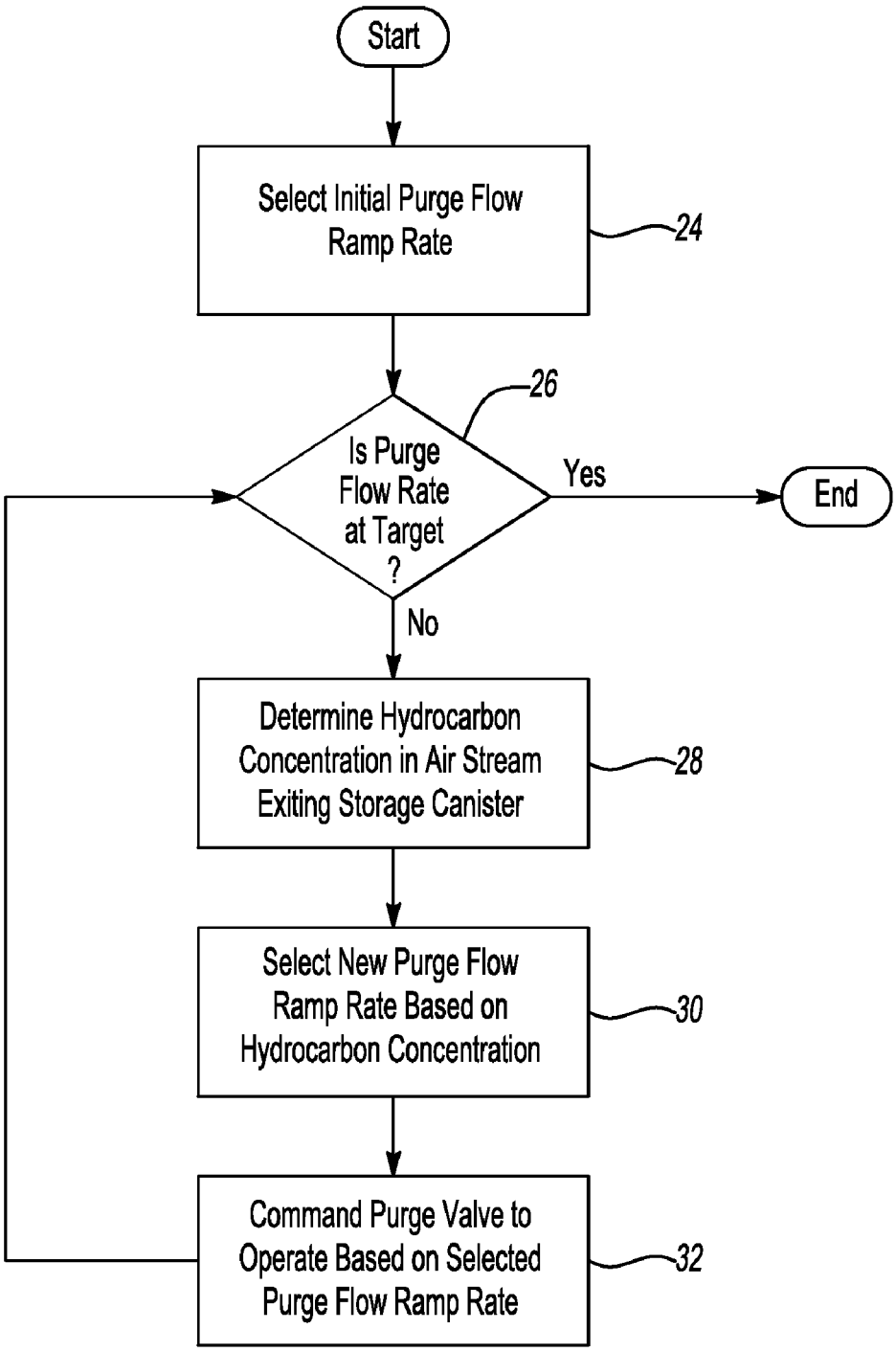
FIG. 6 is a flow chart depicting an embodiment of a strategy for controlling the purge valve of FIG. 1.

Referring now to FIGS. 1 and 6, an initial purge flow ramp rate is selected as indicated at 24. For example, in the absence of information about the initial hydrocarbon concentration, the controller 20 may select a purge flow ramp rate that protects for a 95% hydrocarbon concentration. The controller 20 may select this ramp rate, for example, from a look-up table stored in memory having information similar to that depicted in FIG. 4. Analytical methods may also be used, etc.

As indicated at 26, it is determined whether the purge flow rate is at the target. If yes, the strategy ends. If no, the hydrocarbon concentration is determined as indicated at 28. For example, the controller 20 may determine the air/fuel ratio of the engine 14 based on information from the oxygen sensor 22 using known techniques. The controller 20 may then determine the hydrocarbon concentration in the air stream exiting the storage canister 16 based on changes in the air/fuel ratio relative to the target using known techniques. Other methods, e.g., a hydrocarbon sensor, may also be used.

As indicated at 30, a new purge flow ramp rate is selected based on the hydrocarbon concentration determined at 28. The controller 20 may select this ramp rate from the look-up table mapping hydrocarbon concentration with purge flow ramp rate described above.

As indicated at 32, the controller 20 commands the purge valve 18 to operate based on the purge flow ramp rate selected at 30. The strategy then returns to 26. In some embodiments, the control logic loop formed by 26 through 32 may be executed every 100 milliseconds. Any suitable time interval, however, may be used.

While embodiments of the invention have been illustrated and described, it is not intended that these embodiments illustrate and describe all possible forms of the invention. Rather, the words used in the specification are words of description rather than limitation, and various changes may be made without departing from the spirit and scope of the invention.

What is claimed:

1. A method for controlling an automotive canister purge valve in fluid communication with an evaporative canister comprising:

for at least one of a plurality of time intervals, selecting a rate of increase for a purge flow rate associated with the purge valve based on a hydrocarbon concentration in a fluid stream exiting the evaporative canister, and operating the purge valve based on the selected rate.

2. The method of claim 1 wherein the hydrocarbon concentration in the fluid stream exiting the evaporative canister is determined based on a change in air/fuel ratio to an engine.

3. The method of claim 2 further comprising measuring an oxygen concentration in an exhaust stream from the engine.

4. The method of claim 3 further comprising determining the change in air/fuel ratio to the engine based on a change in oxygen concentration in the exhaust stream from the engine.

5. The method of claim 1 further comprising determining the hydrocarbon concentration in the fluid stream exiting the evaporative canister based on information from a hydrocarbon sensor.

6. The method of claim 1 wherein the rate of increase increases as the hydrocarbon concentration decreases.

7. A method for controlling an automotive canister purge valve in fluid communication with an evaporative canister comprising:

for at least one of a plurality of time intervals, determining an oxygen concentration in an exhaust stream from an engine, selecting a purge flow ramp rate for the purge valve based on the oxygen concentration, and operating the purge valve based on the selected ramp rate.

8. An evaporative emission control system for a vehicle including an engine, the system comprising:

an evaporative canister;

a purge valve in fluid communication with the evaporative canister and engine; and a controller configured to (i) select a rate of increase for a purge flow rate associated with the purge valve based on a hydrocarbon concentration in a fluid stream exiting the evaporative canister and (ii) operate the purge valve based on the selected rate.

9. The system of claim 8 wherein the controller is further configured to determine the hydrocarbon concentration in the fluid stream exiting the evaporative canister based on a change in air/fuel ratio to the engine.

10. The system of claim 9 further comprising a sensor configured to detect a change in oxygen concentration in an exhaust stream from the engine.

11. The system of claim 10 wherein the controller is further configured to determine the change in air/fuel ratio to the engine based on the change in oxygen concentration in the exhaust stream from the engine.

12. The system of claim 8 further comprising a sensor configured to sense the hydrocarbon concentration in the fluid stream exiting the evaporative canister.

13. The system of claim 8 wherein the rate of increase increases as the hydrocarbon concentration decreases.

* * * * *